United States Patent [19]

Heeks

[11] Patent Number: 4,771,409

[45] Date of Patent: Sep. 13, 1988

[54] ELECTRONIC ANALOGUE DISPLAY

[75] Inventor: Thomas R. Heeks, Cheltenham, England

[73] Assignee: Smiths Industries Public Limited Company, London, England

[21] Appl. No.: 840,277

[22] Filed: Mar. 17, 1986

[30] Foreign Application Priority Data

Mar. 21, 1985 [GB] United Kingdom ..... 8507417

[51] Int. Cl.[4] ..... G04B 47/06

[52] U.S. Cl. ..... 368/11; 368/223; 368/241

[58] Field of Search ..... 368/320–322, 368/184–186, 319, 11, 241, 223

[56] References Cited

U.S. PATENT DOCUMENTS 4,364,672 12/1982 Shibuya et al. ..... 368/242
4,379,642 4/1983 Meyrat ..... 368/321
4,385,842 5/1983 Wiesner ..... 368/242
4,419,018 12/1983 Meyrat ..... 368/321
4,600,316 7/1986 Besson ..... 368/185

*Primary Examiner*—Bernard Roskoski
*Attorney, Agent, or Firm*—Pollock, Vande Sande & Priddy

[57] ABSTRACT

An analogue display has a circle of electrically-energizable elements that are selectively energized so as to represent time. A rotatable setting wheel has a knurled edge that projects from the display casing. A leaf spring engages the knurled edge, the spring having a piezoelectric element on its surface which produces pulses dependent on rotation and direction of rotation of the wheel. Different elements are energized around the circle, as the wheel is rotated, according to the speed and direction of rotation. A second value, such as temperature, can be represented if each element extends radially and is divided into separate sub elements. By energizing different numbers of the sub elements, the apparent radial length of the element can be varied to represent the second value.

7 Claims, 4 Drawing Sheets

ELECTRONIC ANALOGUE DISPLAY

BACKGROUND OF THE INVENTION

This invention relates to electronic analogue displays.

The invention is more particularly concerned with displays having an arcuate row of electrically-energisable elements that can be selectively energised to represent a value.

Electronic time switches, clocks and watches may be provided with a digital display in which time is represented by a number, or with an analogue display in which time is represented by selectively energising radial elements arranged around a circular scale.

One problem with such displays arises with the setting or changing of the display. This is especially the case with time switches which have to be programmed with several different times when switching operations are to occur. With time switches, it is often necessary frequently to change the time settings of the switching operations, such as, for example, when controlling domestic heating at weekends.

Several different means are known by which the display can be changed. The display may, for example, have a keyboard in which each key is associated with a different number. By appropriately actuating a combination of keys, a time setting may be entered. Although this may be satisfactory for digital displays where actuation of a key causes display of the number associated with that key, it is less suitable for analogue displays where the time is represented by the position of an element and is therefore less directly associated with the keys on the keyboard. The keyboard also requires a large amount of space.

An alternative arrangement involves the use of only one or two keys. While a key is depressed, the time displayed is advanced in steps, the user releasing the key when the desired time setting is reached. The second key may be used to change the display in the opposite sense. Although such arrangements take up less space, they can be difficult or time consuming to use, since, if accurate setting is to be achieved, the display must be advanced relatively slowly.

BRIEF SUMMARY OF THE INVENTION

It is an object of the present invention to provide an electronic analogue display with improved setting means.

According to one aspect of the present invention, there is provided an electronic analogue display including an arcuate row of electrically-energisable elements, a setting member displaceable in opposite senses, sensor means responsive to the displacement of the setting member, and an addressing unit arranged to address the elements in accordance with the amount of displacement of the setting member and the sense in which the setting member is displaced.

The setting member is preferably rotatable in either direction, the sensor means being responsive to rotation and direction of rotation of the setting member; the addressing unit, being arranged to address different ones of the elements as the setting member is rotated, each element in turn in one direction along the row being addressed as the member is rotated in one direction and each element in turn in the other direction along the row being addressed as the member is rotated in the other direction, and the rate at which different elements are addressed being dependent on the rate of rotation of the setting member.

The setting member may be continuously rotatable and the elements may be arranged in a circle. The setting member may be a rotatable wheel, an edge of the wheel projecting from a casing of the display towards one side of the row of elements.

The elements may extend radially and the addressing unit may be arranged to address the elements to represent a first value. Each element may be divided into separate sub elements along its radial length, the addressing unit being arranged to address different ones of the sub elements to vary the length of element that is energised in accordance with a second value. The first value may be time and the second value may be temperature.

The setting member may have a knurled surface and the sensor means may be arranged to engage the knurled surface. The sensor means preferably includes a spring member arranged to engage with the knurled surface, and a piezoelectric device in contact with the spring member, the piezoelectric device being arranged to produce a first output in response to flexing of the spring member in one sense, caused by displacement of the setting member in one sense, and a second output, different from the first output in response to flexing of the spring member in the opposite sense, caused by displacement of the setting member in the opposite sense.

The addressing unit may be arranged to address a greater number of elements for a predetermined displacement of the setting member when the setting member is displaced rapidly than when the setting member is displaced slowly.

According to another aspect of the present invention, there is provided a time switch including a display according to the above-mentioned one aspect of the present invention.

According to a further aspect of the present invention, there is provided a heating programmer including a display according to the above-mentioned one aspect of the present invention.

Time switches including displays according to the present invention, will now be described, by way of example, with reference to the accompanying drawings.

DETAILED DESCRIPTION

Figure 1:
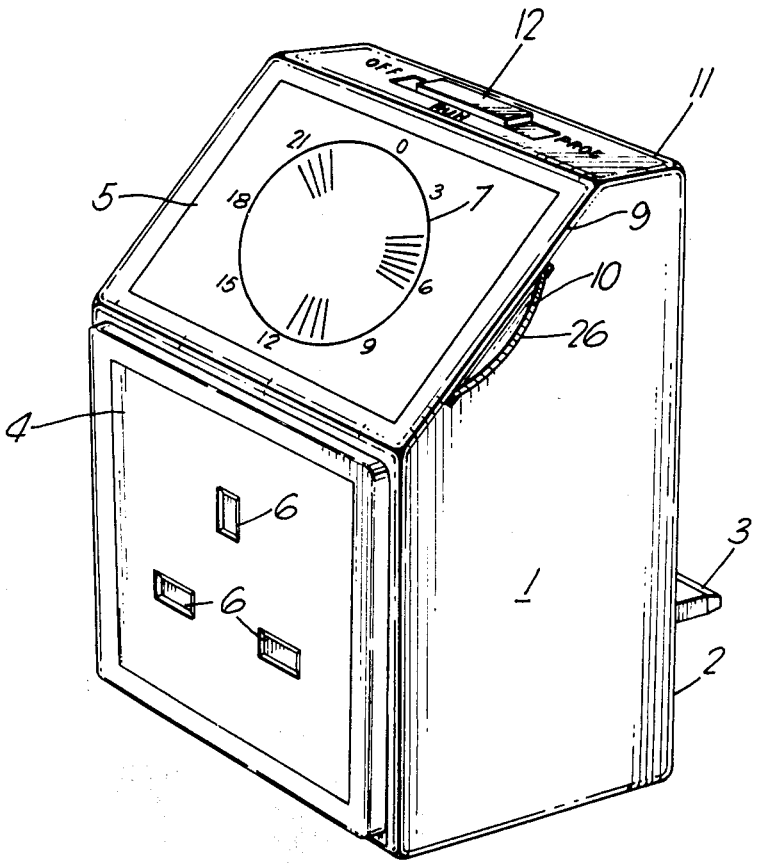
FIG. 1 is a perspective view of a time switch.

The time switch has a generally rectangular casing 1 from the rear face of which project three metal pins 3 that are arranged for insertion into a mains electricity socket. The front of the housing is divided into a vertical lower face 4 and an inclined upper face 5. The lower face 4 is provided with at least one socket 6 for receiving the mains plug (not shown) of the appliance that is to be controlled by the time switch. The upper, inclined face 5 carries a circular, electronic analogue display 7 on which is indicated the present time and the switching period or periods, as explained in more detail below. From the right edge 9 of the inclined face 5 there projects a segment of a setting member or wheel 10 by which the switching periods and time setting can be altered. The top 11 of the casing 1 supports a slider 12 which can be slid between three positions: OFF, RUN and PROGRAMME and which can also be pushed down to an on position control programming of the time switch.

Figure 2:
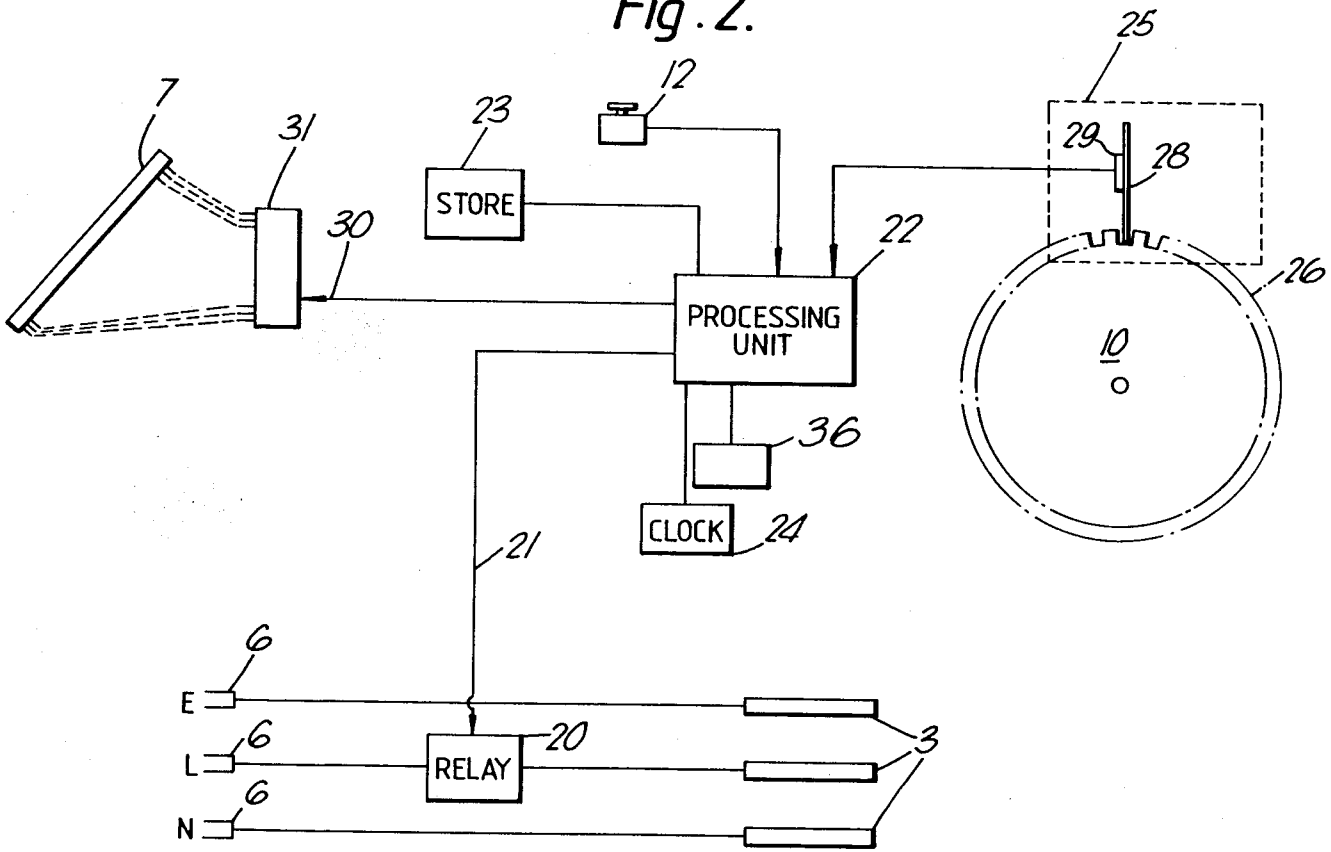
FIG. 2 is a schematic diagram of the time switch.

With reference now to FIG. 2, it will be seen that the earth (E) and neutral (N) sockets are connected directly to the earth and neutral pins 3. The live (L) socket 6 is connected to the live pin 3 via a relay 20 that is controlled by signals on line 21 from a processing unit 22. The processing unit 22 opens and closes the relay 20 according to the programmed switching periods in a store 23. The processing unit 22 also receives signals from a clock 24, from a sensing unit 25 responsive to rotation of the setting wheel 10, and from the slider 12. Power for the processing unit is derived from the mains connection via the pins 3, when the time switch is plugged into a mains socket, or from a lithium battery 26 when the time switch is disconnected, such as, during the programming operation. In addition to controlling the relay 20, the processing unit 22 supplies output signals along line 30 to a dislay drive/addressing unit 31 which controls energisation of the display 7.

Figure 3:
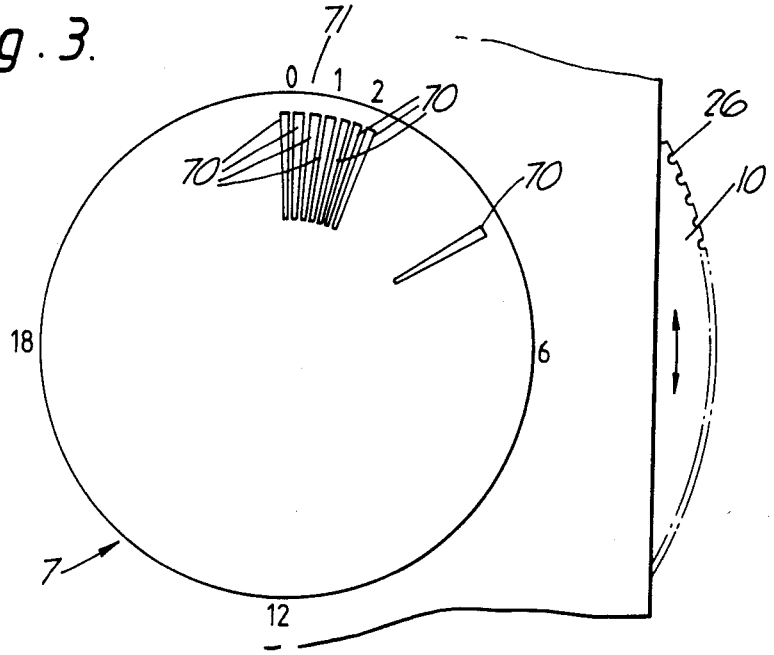
FIG. 3 shows the time switch display in greater detail.

With reference also to FIG. 3, the display 7 comprises ninety-six elements 70 which are arranged side-by-side in a circle, and which take the form of radially-extending bars. The elements 70 are equally spaced around the circle and are located inwardly of a circular scale 71 which carries numbers 0 to 23 corresponding to a twenty-four hour clock. Each element 70 is thereby equivalent to a fifteen minute period. The elements 70 are preferably liquid-crystal display elements although other electrically-energisable elements could be used.

The wheel 10 is mounted so that it can be continuously rotated, that is, through more than 360 degrees, having a knurled edge 26 so that it can be readily rotated by hand. The wheel sensing unit 25 may take several different forms which are responsive to rotation, and the direction of rotation of the wheel 10. The wheel 10 is engaged by a click mechanism, such as a leaf spring 28 which engages the knurled edge 26 or another toothed or serrated region of the wheel. In one form, a bi-morph piezo-electric element 29 is mounted on the leaf spring. As the leaf spring 28 flexes, it distorts the piezo-electric element 29 producing an output pulse. Rotation of the wheel 10 in one direction causes flexure of the spring 28 in one sense, giving rise to a positive voltage peak followed by a negative peak from the piezo-electric element 29. Rotation of the wheel 10 in the other direction causes flexure of the spring 28 in the opposite sense, giving rise to a negative voltage peak followed by a positive peak. In other arrangements for example, a microswitch may be actuated periodically by a click mechanism as the wheel is rotated, and a separate direction sensing switch may be used to respond to the direction of the rotation of wheel 10.

The time switch is programmed in the way outlined below.

The slider 12 is first moved to the right, to the PROGRAMME position which causes the display 7 to energise the element 70 opposite the '0' hours setting on the scale 71. The wheel 10 is then rotated clockwise, causing a train of pulses to be supplied by the sensing unit 25 to the processing unit 22 representative of the direction and the extent of rotation of the wheel. This causes the processing unit 22 and the display drive unit 31 to energise successive adjacent elements 70 around the display 7, only one element being energised at a time to give the appearance of a rotating dark bar.

When the dark bar reaches the desired time at which the first switching-on period is to start, the user presses down the slider 12 into its ON position. The user holds the slider 12 down while rotating the wheel 10 further until the end of the first switching-on period is reached, as depicted by further rotation of the dark bar against the scale 71. While the slider 12 is held down, intermediate elements 70 around the display are darkened, producing an arc of dark elements corresponding to the first period in which the appliance is to be switched on. The slider 12 is then released and the wheel 10 rotated further to cause the dark bar to be rotated, without permanently darkening intermediate elements, until the start of the next period. The slider 12 is then pressed down again while the wheel 10 is rotated to cause rotation of the dark bar through the next period when the appliance is to be switched on, thereby darkening intermediate elements and producing a second arc of dark elements. When the end of the second switching-on period is reached, the slider 12 is released again. This procedure is repeated until all the switching times are programmed. Large intervals of time can be passed by rotating the wheel 10 quickly. Accurate setting is achieved by rotating the wheel 10 slowly, and by rotating the wheel 10 backwards if the time setting is accidentally overshot.

When all the switching periods have been programmed, the slider 12 is set to the RUN position which causes the element 70 addressed at the time to be intermittently energised, giving a flashing appearance. The wheel 10 is then rotated clockwise or anticlockwise until the flashing bar is set at the present time, following which it will be rotated around the scale with time, under control of the clock unit 24. The programming of the time switch can be carried out when the unit is not plugged into the mains socket, power for this being derived from the battery 26. This enables the time switch to be set in the user's hand rather than in an inconvenient position in a wall socket. As soon as the unit is plugged back into the mains socket, power to drive the processing unit 22, display 7, and relay 20 etc. is derived from the mains source, although, in other embodiments, the battery could provide the power permanently.

The arrangement of the present invention has several advantages. The setting arrangement takes up very little space on the exterior of the unit, thereby enabling the overall size of the unit to be kept to a minimum. Because rotation of the bar around the display is achieved by rotating a wheel it is easy to use even by inexperienced users, since movement of the setting wheel produces an equivalent displacement on the display. Accurate and rapid setting can be achieved because the display can be advanced or reversed at the desired rate, slowly or quickly, as necessary. One complete revolution of the wheel may be arranged to produce one revolution around the display, or it may be scaled to produce more or less than one revolution.

The processing unit could be arranged to be responsive to the speed of rotation of the wheel 10, in such a way that the display is advanced at a faster rate, for a predetermined rotation of the wheel, when the wheel is rotated quickly. For example, at a slow speed the display 7 could be advanced by one element 70 for every click of the wheel 10, whereas, when the wheel is rotated quickly, the display could be advanced by more than one element for every click of the wheel. This may be particularly useful where the time switch can be programmed with different time periods for different days, since programming might require the setting wheel 10 to be spun through a complete rotation for each day.

Figure 4:
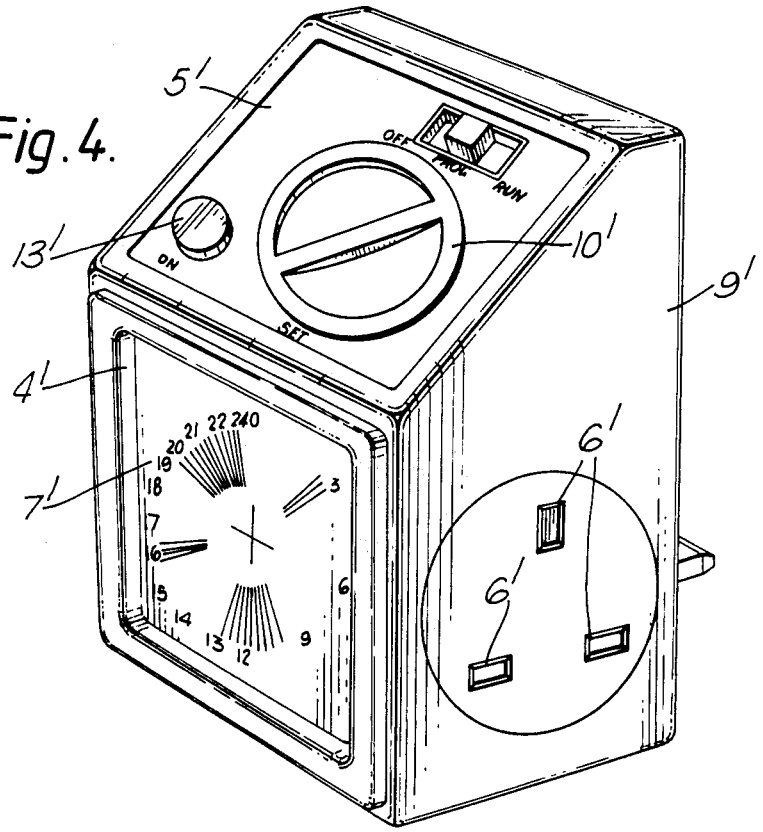
FIG. 4 is a perspective view of an alternative time switch.

The setting wheel need not be edge mounted but could be mounted at other locations, such as shown in FIG. 4. In the arrangement of FIG. 4, the setting wheel 10' is mounted on the inclined upper face 5' of the time switch whilst the display 7' is provided on the lower front face 4' and the socket 6' is provided on a side face 9'. A separate button 13' is used for programming the time switch. Alternatively, the setting wheel could be a knob located in the centre of the display itself.

Figure 5:
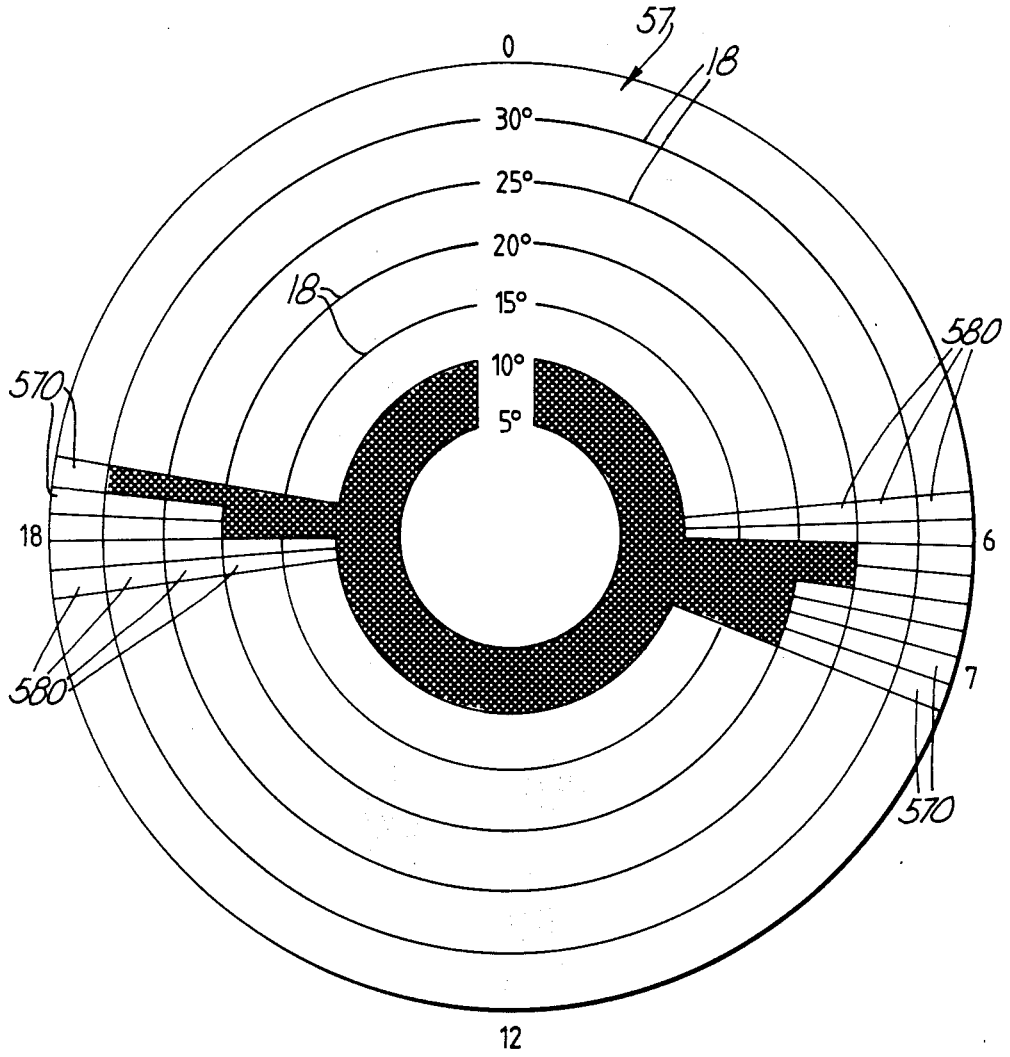
FIG. 5 shows an alternative display.

A display according to the present invention could, for example, be incorporated in a heating programmer or a programmable thermostat. Such devices may include means for setting temperature so that a heater controlled by the device produces different temperatures at different times of the day. The display of such devices may be arranged to represent the temperature programmed at different times of the day, as shown in FIG. 5. In this arrangement, each of the radially-extending elements 570 is formed from a row of smaller sub-elements 580. All of the elements 570 are energised, their apparent length being varied by energising selected ones of these sub-elements 580. Low temperatures are represented by making the element 570 short, high temperatures being represented by energising more of the sub-elements so that the element is longer. The display 57 may be marked with a scale formed of several concentric rings 18 labelled with temperature so that the length of the elements 570 in terms of temperature can be determined.

Liquid crystal display matrices having large numbers of pixels are now commonly available and these can also be employed to produce a display of radial bars of varying length resembling the display shown in FIG. 5. Various other ways of representing temperature could be employed.

What I claim is:

1. An electronic analog display for a heating and/or cooling programmer in which both time and temperature are represented, a plurality of radially extending, angularly spaced, electronically energizable display elements each of which is divided into a plurality of radially disposed sub-elements, an adjustable setting member which is controllable to set a desired time value, means responsive to said setting member for selectively energizing said display elements in accordance with the desired time value to provide thereby, as a result of the angular position of the energized one or more display elements, a clock-like representation of such desired time value, said responsive means further selectively energizing a controllable number of contiguous sub-elements of at least one of said display elements in accordance with a predetermined temperature setting so that the visually apparent length of the respective one or more display elements can be selectively controlled at any location around said circle, whereby said analog display provides an easily decipherable representation of time and temperature by the clock-like selective display of one or more sector-shaped regions of energized sub-elements, the location of which around the circle represents time, the angular width of which represents the duration of the period, and the radial length of which represents temperature, during the respective period represented by said region.

2. A display according to claim 1, wherein the setting member is rotatable in either direction, said responsive means is responsive to rotation and direction of rotation of the setting member, and said responsive means addresses different ones of said display elements as said setting member is rotated, each element in turn in one direction along the row being addressed as the member is rotated in one direction and each element in turn in the other direction along the row being addressed as the member is rotated in the other direction, and wherein said responsive means addresses different elements at a rate dependent on the rate of rotation of the setting member.

3. A display according to claim 2, wherein the said setting member is continuously rotatable.

4. A display acccording to claim 1, wherein the said setting member is a rotatable wheel, wherein the display includes a casing, and wherein an edge of the wheel projects from the casing towards one side of the row of elements.

5. A display according to claim 1, wherein the setting member has a knurled surface, and wherein said responsive means includes a sensor located to engage the knurled surface.

6. A display according to claim 5, wherein the sensor means includes a spring located to engage with the knurled surface and a piezoelectric device in contact with the spring, and wherein the piezoelectric device produces a first output in response to flexing of the spring in one sense, caused by displacement of the setting member in one sense, and a second output, different from the first output, in reponse to flexing of the spring in the opposite sense caused by displacement of the setting member in the opposite sense.

7. A display according to claim 1, wherein the addressing unit addresses a greater number of elements for a predetermined displacement of the setting member when the setting member is displaced rapidly than when the setting member is displaced slowly.

* * * * *